US005783068A

United States Patent [19]

Laborde et al.

[11] Patent Number: 5,783,068

[45] Date of Patent: Jul. 21, 1998

[54] PROCESS FOR DECHLORINATION OF A SPENT OIL FRACTION

[75] Inventors: Michel Laborde; Philippe Dolbecq, both of Le Havre, France

[73] Assignee: Total Raffinage Distribution, S.A., Puteaux, France

[21] Appl. No.: 646,234

[22] PCT Filed: Sep. 11, 1995

[86] PCT No.: PCT/FR95/01162

§ 371 Date: May 13, 1996

§ 102(e) Date: May 13, 1996

[87] PCT Pub. No.: WO96/08546

PCT Pub. Date: Mar. 21, 1996

[30] Foreign Application Priority Data

Sep. 13, 1994 [FR] France ..... 94 10899

[51] Int. Cl.[6] ..... C10G 17/00

[52] U.S. Cl. ..... 208/262.1; 208/262.1; 208/179; 585/820

[58] Field of Search ..... 208/262.1, 179; 588/820

[56] References Cited

U.S. PATENT DOCUMENTS

| | | | |
|---|---|---|---|
| 2,481,300 | 9/1949 | Eingel | 208/262.1 |
| 3,761,534 | 9/1973 | Sun et al. | 208/262.1 |
| 4,612,404 | 9/1986 | Thyagarajan | 568/730 |
| 4,639,309 | 1/1987 | Lalancette et al. | 208/262.1 |
| 5,096,600 | 3/1992 | HQCH | 210/909 |

*Primary Examiner*—Helane Myers

*Attorney, Agent, or Firm*—Frommer Lawrenece & Haug LLP

[57] ABSTRACT

The present invention relates to a process for dechlorinating a spent lubricating oil fraction, optionally mixed with another hydrocarbon stock. Upstream of the recycling operation in refining the spent oil, the latter is subjected to a dechlorination operation at least partially by passing it on a bed of particles (6) of a composition which neutralizes by absorption and containing, as active compound capable of fixing the chlorine, at least one metal oxide and/or at least one metal hydroxide.

22 Claims, 2 Drawing Sheets

Feedstock: topped oil, Cl = 325 ppm

Hourly space velocity = 0.5

PROCESS FOR DECHLORINATION OF A SPENT OIL FRACTION

The invention relates to a process for dechlorination of a spent oil fraction.

BACKGROUND OF THE INVENTION

It is known that spent lubricating oils recovered in garages or service stations represent considerable tonnages which in France, for example, are as high as 100,000 metric tons and even 120,000 metric tons per year.

For a long time, therefore, attempts have been made to avoid disposing of these spent oils, as this would contribute substantially to environmental pollution. Currently, these oils are therefore usually subjected to a regeneration treatment.

Said treatment is costly, however, because these spent oils contain a large amount of various metals and chlorine, and the regenerated oils are practically as costly as new oils coming from the refinery.

This has provided a stimulus for looking for other uses for these spent oils, for example as fuels, particularly in cement plants. In this application, however, the presence of large amounts of chlorine (about 400 to 2000 ppm) also presents problems.

Hence, it has been proposed to recycle these spent oils to refineries to subject them to distillation, optionally in admixture with other feedstocks, so as to recover at least a fraction of the valuable compounds they contain.

Preliminary tests carried out to this end have shown that in such a utilization the chlorine compounds contained in the oils once again present serious problems. These compounds are in fact organic chlorides stemming from oil additives usually containing chlorinated compounds, particularly chlorinated polyisobutenes. During a distillation operation, even at relatively low temperature and particularly in the presence of steam, the molecules of these chlorinated compounds decompose with formation of, in particular, hydrochloric acid which exerts a strong corrosive effect on the refinery equipment.

OBJECTS OF THE INVENTION

Hence, the purpose of the present invention is to bring the chlorine content of spent oils to a level compatible with recycling such oils to refineries, and to this end the invention proposes to use solid compositions capable of binding chlorinated ions and already known industrially for use in other applications and under different conditions.

In fact, industry already uses special compositions known as chlorine scavengers ["chlorine traps"] and based on alumina or metal oxides or metal hydroxides, such as CaO, $Na_2O$, $K_2O$, MgO and the corresponding hydroxides, to eliminate the chlorine present in liquid or gaseous streams of process units, particularly reforming and isomerization units.

In general, said compositions have a special particle size of 0.5 to 3 mm and they usually neutralize [deactivate] chlorine by adsorption. They are usually used at room temperature or at the most at 100° C. and atmospheric pressure, and they usually retain about 15% of the chlorine present in the treated stock.

SUMMARY OF THE INVENTION

Applicant has now found that such chlorine scavengers are very well suited to partial dechlorination of spent oils to be performed upstream of any recycling operation in refineries and particularly of any vacuum distillation and that, unexpectedly, the chlorine fixation capacity of such scavengers increases markedly with the temperature of the treated oils, said scavengers being capable of retaining at a temperature from 300° to 400° C. and atmospheric pressure at least 40% of the chlorine present in the treated oil.

As will be seen in the following, it is of course also possible to operate at a different temperature and/or pressure.

This chlorine quantity that exceeds 40% represents approximately the fraction of chlorinated compounds that decompose, with formation of hydrochloric acid, in the course of recycling spent oils or of chlorinated compounds oils that distill in a vacuum fractionating column for spent oil. The invention therefore proposes, in simple fashion, to subject spent oils to dechlorination upstream of any recycling operation.

Hence, the invention is embodied by a process for dechlorinating a fraction of spent lubricating oil, optionally in admixture with another hydrocarbon feedstock, said process being characterized by the fact that, upstream of a spent oil recycling operation in a refinery, the spent oil is subjected to at least partial dechlorination by passing said oil over a bed of particles of a composition capable of neutralizing by adsorption and containing as active chlorine-fixing compound at least one oxide of a metal belonging to groups I and II of the periodic table and/or at least one hydroxide of a metal belonging to groups I and II of the periodic table.

The active compound of the neutralizing composition is preferably an oxide of calcium, magnesium, sodium or potassium. Calcium oxide and calcium hydroxide are even more preferred as active compounds.

The dechlorination step is preferably carried out under conditions such that at least 40%, and preferably 60% of the amount of chlorine present in the spent oil will be retained by adsorption on the neutralizing composition. Such conditions are, for example, the following: a temperature of at least 150° C. and preferably about 400° C., an hourly space velocity of the spent oil of 0.5 $h^{-1}$ (volume of spent oil per unit volume of adsorbent per hour) and a pressure essentially equal to atmospheric pressure.

The use of different temperatures and/or pressures is also within the scope of the invention.

In a preferred embodiment of the invention, before being dechlorinated the oil is subjected to atmospheric distillation at a temperature of 300°–400° C. to remove the water and low-boiling solvents contained in the oil. The dechlorination is then performed on the spent oil obtained by this atmospheric distillation, optionally after reheating said oil, for example by heat exchange, to increase the efficacy of dechlorination.

The spent oil dechlorinated in this manner, preferably in admixture with another feedstock, for example a residue from an atmospheric distillation, can then be subjected, for example, to vacuum distillation so as to separate it under vacuum into gas oil, a distillate and an asphalt residue, without, as usually occurs at this stage, forming hydrochloric acid which causes severe equipment corrosion.

Naturally, the atmospheric distillation and the vacuum fractionation or other operations performed on the residue dechlorinated in this manner are carried out in series and continuously.

As indicated hereinabove, the dechlorination compositions used in the process according to the invention are well known in industry and contain, in general, at least 25 wt % of active compound. They are marketed, for example, under the commercial names TRAP'IT made by Catalysts and Chemicals Europe, SELEXSORB HCl made by ALCOA and DISCOVERY ALUMINAS made by Dycat International.

The preferred composition for realizing the invention is the one marketed under the name TRAP'IT which contains from 23.0 to 27.0 wt % of CaO, as the active compound and from 43 to 53.0 wt % of zinc oxide acting as carrier, the remainder to 100% consisting of a binder.

This composition has, in general, an apparent density from 0.720 to 0.800 $cm^3/g$, a pore volume from 0.35 to 0.45 $cm^3/g$ and a specific surface of at least 22 $m^2/g$. It is usually in the form of small rods 1.2 to 1.8 mm in diameter and about 4.0 to 12.0 mm long.

BRIEF DESCRIPTION OF THE DRAWINGS

In this specification and in the accompanying drawings, we have shown and described preferred embodiments of our invention and have suggested various alternatives and modifications thereof; but it is to be understood that these are not intended to be exhaustive and that many other changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

DETAILED DESCRIPTION OF PREFERRED EMBODIMENTS OF THE INVENTION

Figure 1:
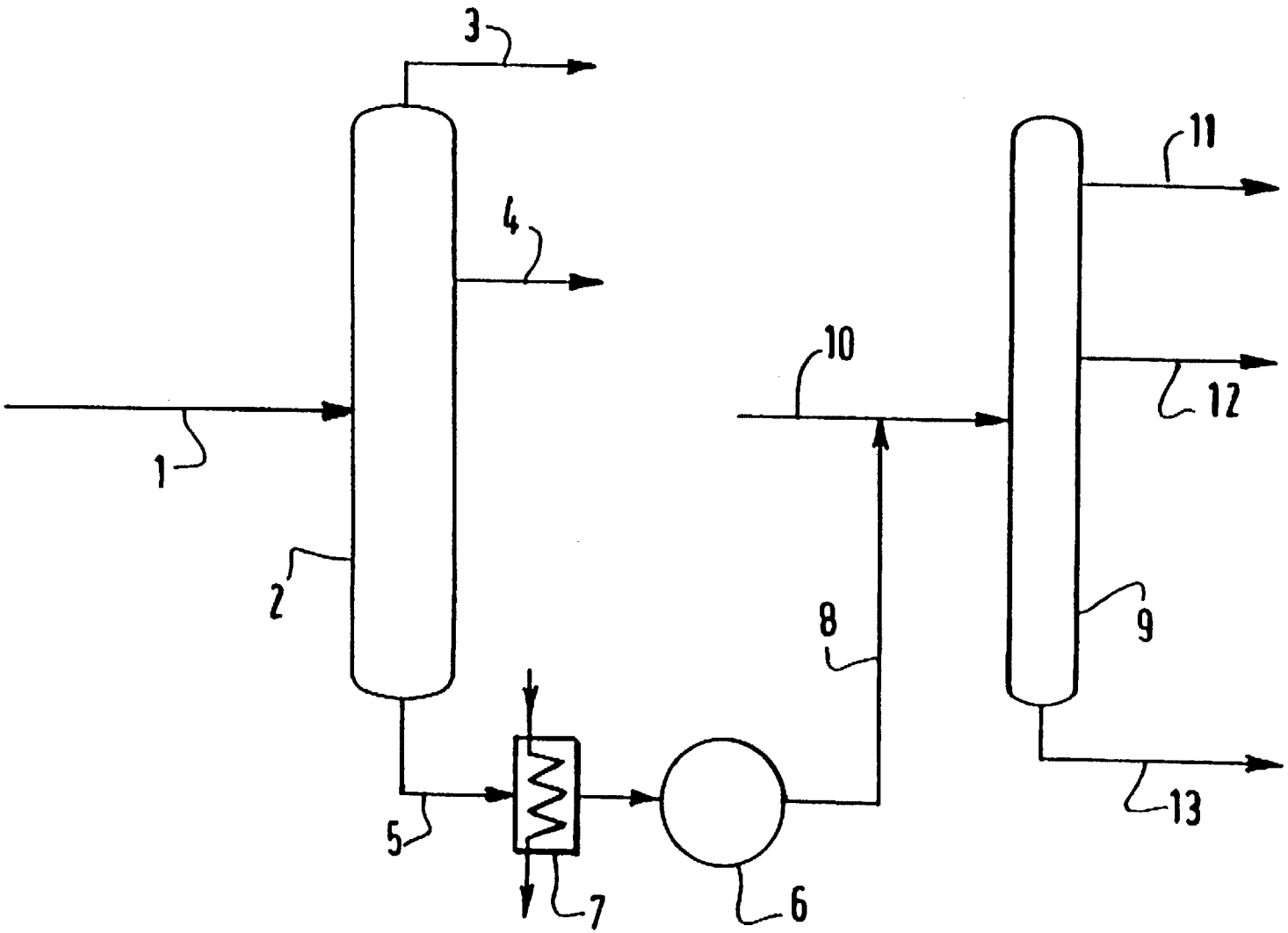
FIG. 1 is a general schematic illustrating said embodiment of the invention.

In the embodiment of the invention illustrated in FIG. 1, the spent oil to be treated, fed through line 1, is at first topped by atmospheric distillation in column 2. The water present in the spent oil (4–10 wt %) is removed overhead through line 3, whereas the low-boiling solvents are removed through line 4.

The topped oil, removed at the bottom of the column through line 5 at a temperature of 300°–400° C., most often contains about 500 ppm of chlorine. Said oil then passes through a drum 6 containing the special composition used as chlorine scavenger. If dechlorination is to be carried out at a higher temperature, a heat exchanger 7 can be inserted into line 5 upstream of drum 6. The chlorine scavenger contained in drum 6 retains about 60% of the chlorine present in the spent oil, and the treated oil, which contains no more than 200 ppm of chlorine, is removed through line 8 in the direction of a vacuum distillation column 9, said oil being fed to the column, for example, together with a residue from an atmospheric distillation, said residue arriving through line 10.

The chlorine content of the treated oil is compatible with the conditions of vacuum distillation which takes place without any risk of corrosion brought about by the formation of hydrochloric acid in column 9.

The following is usually removed from said column under vacuum:

gas oil overhead, through line 11, a distillate at an intermediate level, through line 12, a residue usable as asphalt at the bottom of the column, through line 13.

The following Example 1 refers to an application of the process according to the invention in the equipment shown in FIG. 1, it being understood that other embodiments are also within the scope of the invention. Example 2 illustrates the improvement in dechlorination of the treated oil observed with increasing dechlorination temperature.

EXAMPLE 1

This example refers to treatment, in the equipment shown in FIG. 1, of a spent oil having the following characteristics:

density: 909.9 $kg/m^3$;

total chlorine content: 1036 ppm.

This oil was subjected to atmospheric distillation in column 1 under the following conditions:

transfer temperature: 360° C.;

atmospheric pressure.

This gave 3.7 wt % of water through line 3 and 5.5% of low-boiling chlorinated solvents through line 4.

The topped spent oil, collected at a temperature of 360° C. at the bottom of the column through line 5, contained 325 ppm of chlorine. The oil was subjected to dechlorination in drum 6 at a temperature of 320° C. The composition used for this treatment was TRAP'IT (registered trademark) the make-up of which was given hereinabove. Drum 6 contained 15 $m^3$ of TRAP'IT, and the dechlorination treatment was effected at an hourly space velocity of 0.5 $h^{-1}$.

The oil leaving drum 6 through line 8 contained only 123 ppm by weight of chlorine. In other words, 62% of the chlorine present in the oil entering drum 6 was fixed and retained by the TRAP'IT composition.

The oil partially dechlorinated in this manner was then mixed with an atmospheric distillation residue in a 7:100 weight ratio, and the mixture was fed to vacuum distillation column 9. Here the oil was treated under the following conditions:

transfer temperature: 400° C.;

pressure at the head of the column: $5\times10^3$ Pa.

This gave, through lines 11, 12 and 12, respectively, 2 wt % of gas oil, 57 wt % of distillate and 41 wt % of residue, all obtained under vacuum. These materials had the following properties.

| | |
|---|---|
| Gas oil: | chlorine content <50 ppm, |
| Vacuum distillate: | chlorine content <3 ppm, |
| Vacuum distillation residue: | chlorine content <15 ppm. |

By measuring the chloride content of the condensed water, the hydrochloric acid content at the head of the column was determined. It was found that dechlorination of spent oil makes it possible to reduce the chloride content in the overhead water to less than 20 mg/L at a pH of about 5, thus avoiding all problems.

This example shows clearly the efficacy of the process of treating spent oils by vacuum fractionation according to the invention.

After use, the TRAP'IT composition can be discarded or regenerated.

EXAMPLE 2

This example is intended to show the value of conducting the dechlorination operation at the highest possible temperature.

A topped spent oil feedstock containing 325 ppm of chlorine was treated in a drum containing 15 $m^3$ of the TRAP'IT composition at an hourly space velocity of 0.5 $h^{-1}$. The treatment was carried out at varying temperatures, and each time the degree of dechlorination, namely the fraction of chlorine contained in the feedstock that was retained by the dechlorination composition, expressed in %, was measured.

The following Table I shows the results obtained.

TABLE I

| Dechlorination Temperature (°C.) | Degree of Dechlorination (%) |
|---|---|
| 40 | 20.0 |
| 130 | 26.7 |
| 280 | 56.9 |
| 300 | 58.4 |
| 320 | 64.6 |
| 340 | 79.0 |
| 400 | 95 |

Figure 2:
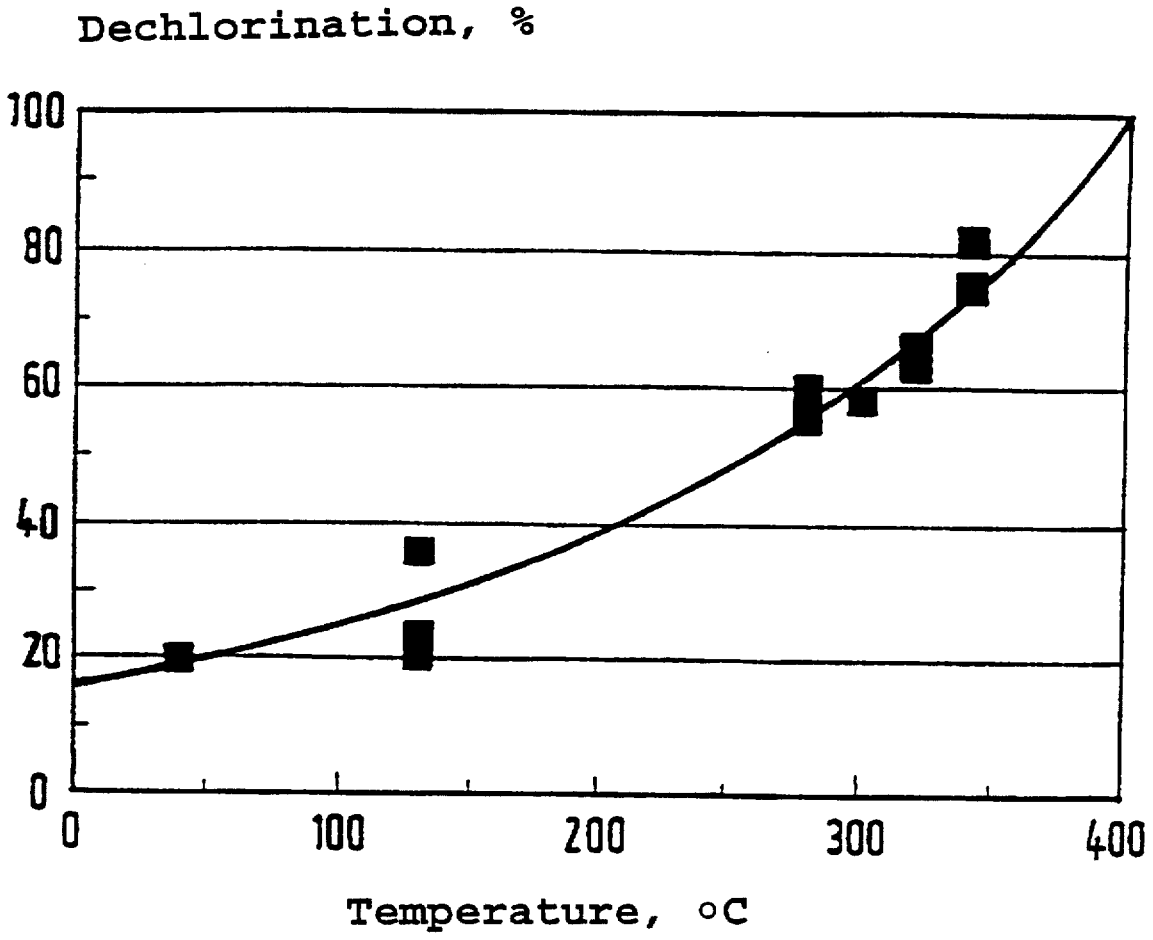
FIG. 2 is a diagram illustrating the increase in degree of dechlorination (expressed in %) as a function of temperature (expressed in ° C.)

FIG. 2 shows a plot of these results. It can be seen that the degree of dechlorination increases nearly exponentially as a function of temperature. This indicates the value of carrying out the dechlorination at the highest possible temperature. For economy of operation, the dechlorination step is preferably carried out at about 350° C.

In the foregoing examples we used the TRAP'IT composition, but the DYCAT 115 composition whose properties are presented in the following Table II is also quite suitable. This is indicated by the fact that it gave results very similar to those obtained with TRAP'IT. It is also possible to use compositions based on sodium hydroxide or potassium hydroxide whose dechlorination properties are quite similar to those of the TRAP'IT and DYCAT 115 compositions.

The composition of DYCAT 115 in wt % is shown in the following Table II. DYCAT 115 consists of particles about 3–5 mm in diameter.

TABLE II

| Compound | Weight Percent |
|---|---|
| Calcium oxide | at least 60 |
| Aluminum oxide | 8 |
| Manganese oxide | 5 |
| Sodium oxide | 4.5 |
| Silica | 5.0 |
| Lead | <0.1 |
| As, Cd | traces |

The tests carried out by Applicant prove that equally favorable results are obtained by substituting calcium hydroxide, $Ca(OH)_2$, for the calcium oxide of these compositions.

The foregoing examples clearly illustrate the advantages of the invention which makes it possible to reutilize spent lubricating oils in refineries by a simple and inexpensive dechlorination treatment.

We claim:

1. A hydrocarbon refining process including at least a partial dechlorination of spent lubricating oil, comprising:

(a) passing said spent lubricating oil over a bed consisting essentially of particles of a composition containing one or more active chlorine-fixing compounds selected from the group consisting of Group I metal hydroxides, Group I metal oxides, Group II metal hydroxides and Group II metal oxides, wherein said dechlorination is carried out at a temperature of at least 150° C., whereby sufficient dechlorination is achieved to protect equipment in subsequent refining by the adsorption of chlorine-containing compounds on said chlorine-fixing compounds; and (b) introducing said dechlorinated lubricating oil as at least part of the feedstock for subsequent steps in the refining process.

2. The process of claim 1, wherein dechlorination is effective to prevent the formation of hydrochloric acid in the subsequent steps of the refining process.

3. The process of claim 1, wherein said dechlorinated spent lubricating oil is admixed with another refinery hydrocarbon feedstock with substantially less or no chlorine content.

4. The process of claim 1, wherein dechlorination is carried our under conditions effective to result in at least 40% of the chlorine present in said spent lubricating oil being adsorbed on said composition.

5. The process of claim 4, wherein dechlorination results in about 60% of the chlorine present in said spent lubricating oil being adsorbed on said composition.

6. The process of claim 4, wherein dechlorination is carried out at a temperature of at least 150° C. and wherein the hourly space velocity of the spent lubricating oil is about 0.5 $h^{-1}$.

7. The process of claim 6, wherein prior to dechlorination said spent lubricating oil is distilled at atmospheric or near atmospheric pressure at a temperature of 300° to 400° C. to remove water and low-boiling solvents contained in said spent lubricating oil.

8. The process of claim 1, wherein dechlorination is carried out at a temperature of at least 150° C. and wherein the hourly space velocity of the spent lubricating oil during dechlorination is about 0.5 $h^{-1}$.

9. The process of claim 1, wherein dechlorination is carried out at a temperature of about 400° C. and wherein the hourly space velocity of the spent lubricating oil during dechlorination is about 0.5 $h^{-1}$.

10. The process of claim 1, wherein prior to dechlorination said spent lubricating oil is distilled at atmospheric or near atmospheric pressure at a temperature of 300° C. to 400° C. to remove water and low-boiling solvents contained in said spent lubricating oil.

11. The process of claim 10, wherein said spent lubricating oil has about 300 ppm or more of chlorine and after distillation is heated to an effectively higher temperature prior to dechlorination sufficient to result in about 40% of the chlorine present in said spent lubricating oil being adsorbed on said composition.

12. The process according to claim 1, wherein said active chlorine-fixing compound is an oxide of at least one calcium, magnesium, sodium and potassium.

13. The process according to claim 1, wherein said active chlorine-fixing compound is an oxide of calcium.

14. The process of claim 1, wherein said active chlorine-fixing compound is a hydroxide of at least one of calcium, magnesium, sodium and potassium.

15. The process of claim 1, wherein said active chlorine-fixing compound is a hydroxide of calcium.

16. The process of claim 1, wherein said spent lubricating oil is vacuum distilled upstream of the dechlorination.

17. The process of claim 1, wherein prior to the dechlorination said spent lubricating oil is distilled at atmospheric or near atmospheric pressure at a temperature of 300° to 400° C. to remove water and low-boiling solvents contained in said spent lubricating oil, wherein the dechlorination is carried out at a temperature of at least 150° C. and with an hourly space velocity of the spent lubricating oil of about 0.5 $h^{-1}$, wherein said active chlorine-fixing compound is an oxide or hydroxide of at least one of calcium, magnesium, sodium and potassium, and wherein the dechlorination results in at least 40% of the chlorine present in said spent lubricating oil being adsorbed on said composition.

18. The process of claim 17, wherein dechlorinated spent lubricating oil is admixed with another hydrocarbon feedstock.

19. The process of claim 17, wherein said active chlorine-fixing compound is an oxide of calcium, the major portion of said particles additionally being ZnO as a carrier with a smaller percentage being a binder.

20. The process of claim 17, wherein the chlorine present in the dechlorinated spent lubricating oil is less than 20 mg/liter with a pH of about 5 or more.

21. The process of claim 17, wherein the chlorine present in the dechlorinated spent lubricating oil is less that 200 ppm.

22. A process for preparing a fraction of spent lubricating oil as a petroleum refinery feedstock, comprising subjecting the spent oil to at least partial dechlorination by passing said oil over a bed consisting essentially of particles of a composition containing as an active chlorine-fixing compound at least one oxide or hydroxide of a metal belonging to groups I and II of the periodic table and mixtures thereof, wherein said dechlorination is carried out at a temperature of at least 150° C., whereby sufficient dechlorination is achieved to protect equipment in subsequent refining by adsorption of chlorine-containing compounds on said chlorine-fixing compound.

* * * * *